US011940211B2

(12) United States Patent
Hu et al.

(10) Patent No.: US 11,940,211 B2
(45) Date of Patent: Mar. 26, 2024

(54) REFRIGERATOR APPLIANCE WITH SMART DOOR ALARM

(71) Applicant: Haier US Appliance Solutions, Inc., Wilmington, DE (US)

(72) Inventors: Haitian Hu, Louisville, KY (US); Hairong Li, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/670,803

(22) Filed: Feb. 14, 2022

(65) Prior Publication Data

US 2023/0258398 A1 Aug. 17, 2023

(51) Int. Cl.
*F25D 29/00* (2006.01)

(52) U.S. Cl.
CPC ..... *F25D 29/008* (2013.01); *F25D 2700/02* (2013.01)

(58) Field of Classification Search
CPC .... A47L 15/4257; F25B 49/022; F25D 11/02; F25D 23/02; F25D 23/028; F25D 29/00; F25D 29/005; F25D 29/008; F25D 2700/02; G06K 9/00624
USPC ..... 340/686.1
See application file for complete search history.

(56) References Cited

U.S. PATENT DOCUMENTS 3,996,434 A * 12/1976 Griffin ..... H01H 21/282 200/61.82
4,528,558 A * 7/1985 Steers ..... G08B 21/18 340/549
4,691,195 A * 9/1987 Sigelman ..... G08B 21/18 340/545.4
4,894,643 A * 1/1990 Thompson ..... G08B 21/18 62/131
5,063,372 A * 11/1991 Gillett ..... G08B 13/08 335/206
6,401,466 B1 * 6/2002 Olsen ..... F25D 29/00 62/131
2016/0091243 A1 * 3/2016 Beier ..... E05D 7/00 49/31
2016/0169576 A1 * 6/2016 Takaki ..... F25D 23/12 700/275
2016/0358508 A1 * 12/2016 Cheatham, III ..... G06V 40/172
2020/0110532 A1 * 4/2020 Mani ..... H04N 23/611
2020/0327601 A1 * 10/2020 Kim ..... G06V 20/00
2021/0131011 A1 5/2021 Park et al.
(Continued)

FOREIGN PATENT DOCUMENTS

CN 208504845 U 2/2019
CN 110553449 A 12/2019
(Continued)

*Primary Examiner* — Stephen R Burgdorf
(74) *Attorney, Agent, or Firm* — Dority & Manning, P.A.

(57) ABSTRACT

A refrigerator appliance includes a cabinet defining a food storage chamber with a door movably coupled to the cabinet whereby the door is movable between a closed position and an open position. A method of operating the refrigerator appliance may include, or the refrigerator appliance may be operable for, receiving an intentional door open input and disabling a door alarm of the refrigerator appliance in response to the intentional door open input. Such methods or operations may further include automatically re-enabling the door alarm after disabling the door alarm.

12 Claims, 7 Drawing Sheets

(56) References Cited

U.S. PATENT DOCUMENTS

| | | | | |
|---|---|---|---|---|
| 2021/0180857 | A1* | 6/2021 | Thayyullathil | F25D 29/00 |
| 2021/0331328 | A1* | 10/2021 | Kim | G06F 21/32 |
| 2022/0330072 | A1* | 10/2022 | Zeng | H04W 72/04 |

FOREIGN PATENT DOCUMENTS

| | | | | | |
|---|---|---|---|---|---|
| DE | 102014004704 | A1 | | 8/2015 | |
| IN | 201911048248 | A | | 12/2019 | |
| KR | 20120126449 | A | * | 11/2012 | F25D 29/008 |

* cited by examiner

REFRIGERATOR APPLIANCE WITH SMART DOOR ALARM

FIELD OF THE INVENTION

The present subject matter relates generally to refrigerator appliances, and more particularly to systems and methods for monitoring the status of one or more doors of such refrigerator appliances.

BACKGROUND OF THE INVENTION

Refrigerator appliances generally include a cabinet that defines a chilled chamber. A wide variety of food items may be stored within the chilled chamber. The low temperature of the chilled chamber relative to ambient atmosphere assists with increasing a shelf life of the food items stored within the chilled chamber.

In order to maintain the chilled chamber below ambient temperature, the cabinet is thermally insulated and the chilled chamber is selectively sealingly enclosed by a thermally insulated door. The door is movable to an open position which permits access to the chilled chamber, e.g., for loading items into the chilled chamber or taking items out of the chilled chamber. When the door is in the open position, the chilled chamber is exposed to relatively warm and/or humid air and such exposure, particularly for a prolonged period of time such as when the door is inadvertently left open and unattended, may be detrimental to the food items stored therein and may result in excessive energy consumption by the refrigerator appliance. Thus, some refrigerator appliances include a door alarm or door open notification. Such alarms, however, may be unhelpful or annoying when the door is intentionally left open, such as when loading a large amount of groceries at one time.

Accordingly, a refrigerator appliance with improved door alarms would be useful. More particularly, a refrigerator appliance that is capable of identifying an intentional door opening, and methods of identifying intentional refrigerator door openings, would be useful.

BRIEF DESCRIPTION OF THE INVENTION

Aspects and advantages of the invention will be set forth in part in the following description, or may be apparent from the description, or may be learned through practice of the invention.

In an exemplary embodiment, a method of operating a refrigerator appliance is provided. The refrigerator appliance includes a cabinet defining a food storage chamber with a door movably coupled to the cabinet. The door is movable between a closed position where the food storage chamber is at least partially enclosed by the door and an open position where the door permits access to the food storage chamber. The refrigerator appliance also includes a sensor operable to detect a user presence. The method includes detecting an opening of the door and obtaining an input with the sensor after detecting the opening of the door. The method also includes determining that the opening of the door was intentional and temporarily disabling a door alarm of the refrigerator appliance based on the determination that the opening of the door was intentional.

In another exemplary embodiment, a refrigerator appliance is provided. The refrigerator appliance includes a cabinet defining a food storage chamber with a door movably coupled to the cabinet. The door is movable between a closed position where the food storage chamber is at least partially enclosed by the door and an open position where the door permits access to the food storage chamber. The refrigerator appliance also includes a sensor operable to detect a user presence and a controller. The controller is operable for detecting an opening of the door and obtaining an input with the sensor after detecting the opening of the door. The controller is also operable for determining that the opening of the door was intentional and temporarily disabling a door alarm of the refrigerator appliance based on the determination that the opening of the door was intentional.

In still another exemplary embodiment, a method of operating a refrigerator appliance is provided. The method includes receiving an intentional door open input. The method also includes disabling a door alarm of the refrigerator appliance in response to the intentional door open input. The method further includes automatically re-enabling the door alarm after disabling the door alarm.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
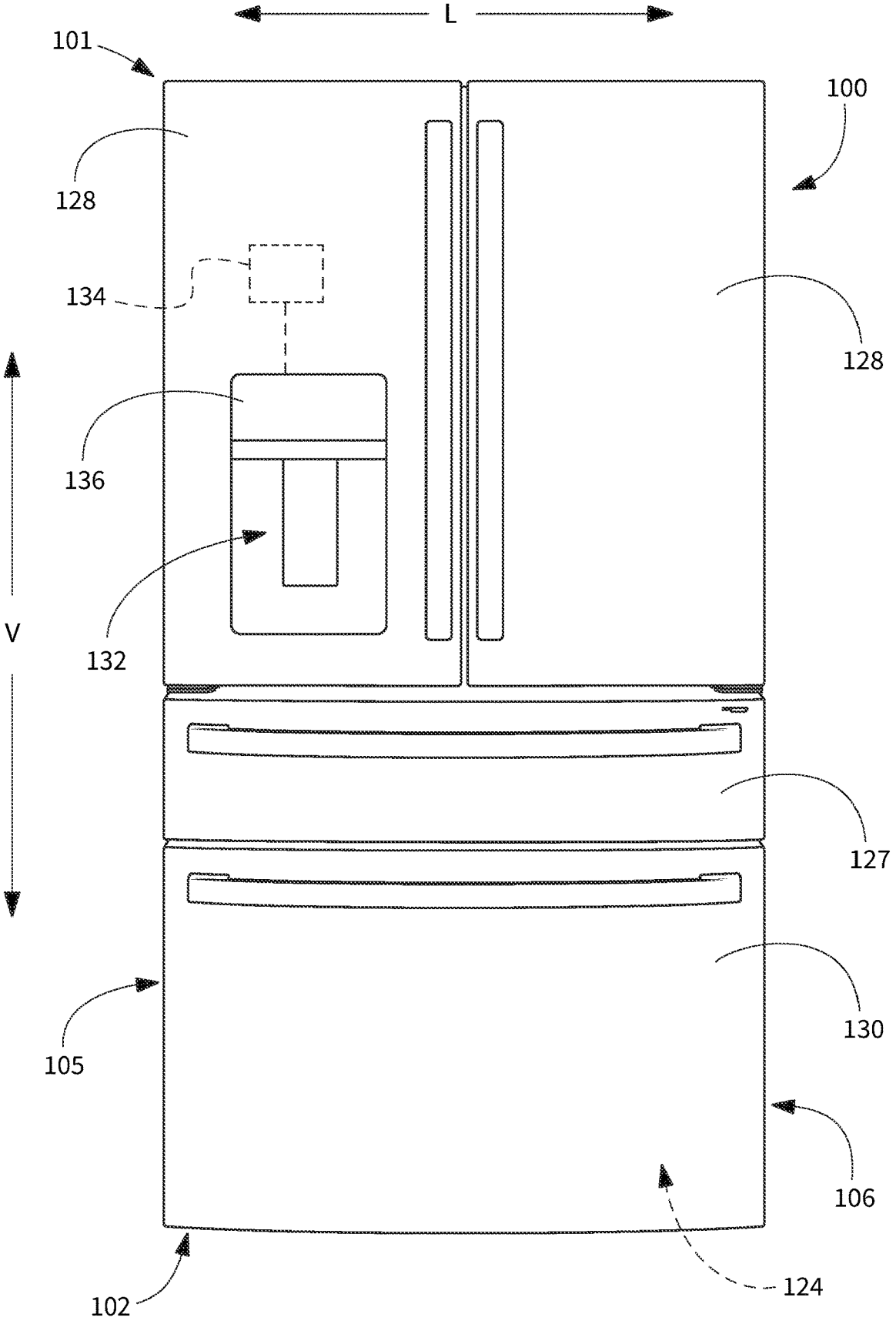
FIG. 1 provides a front view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
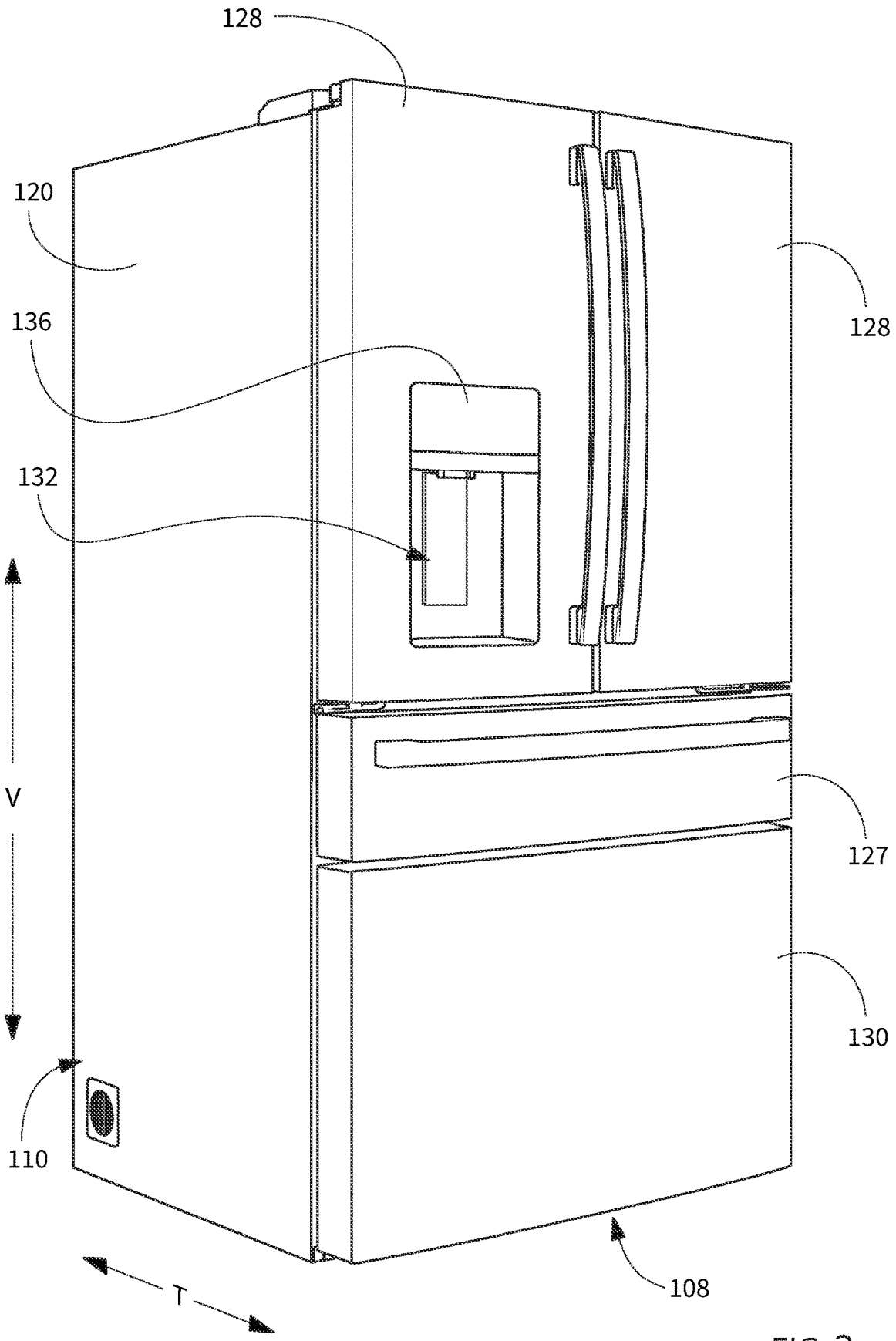
FIG. 2 provides a perspective view of the refrigerator appliance of FIG. 1.
Figure 3:
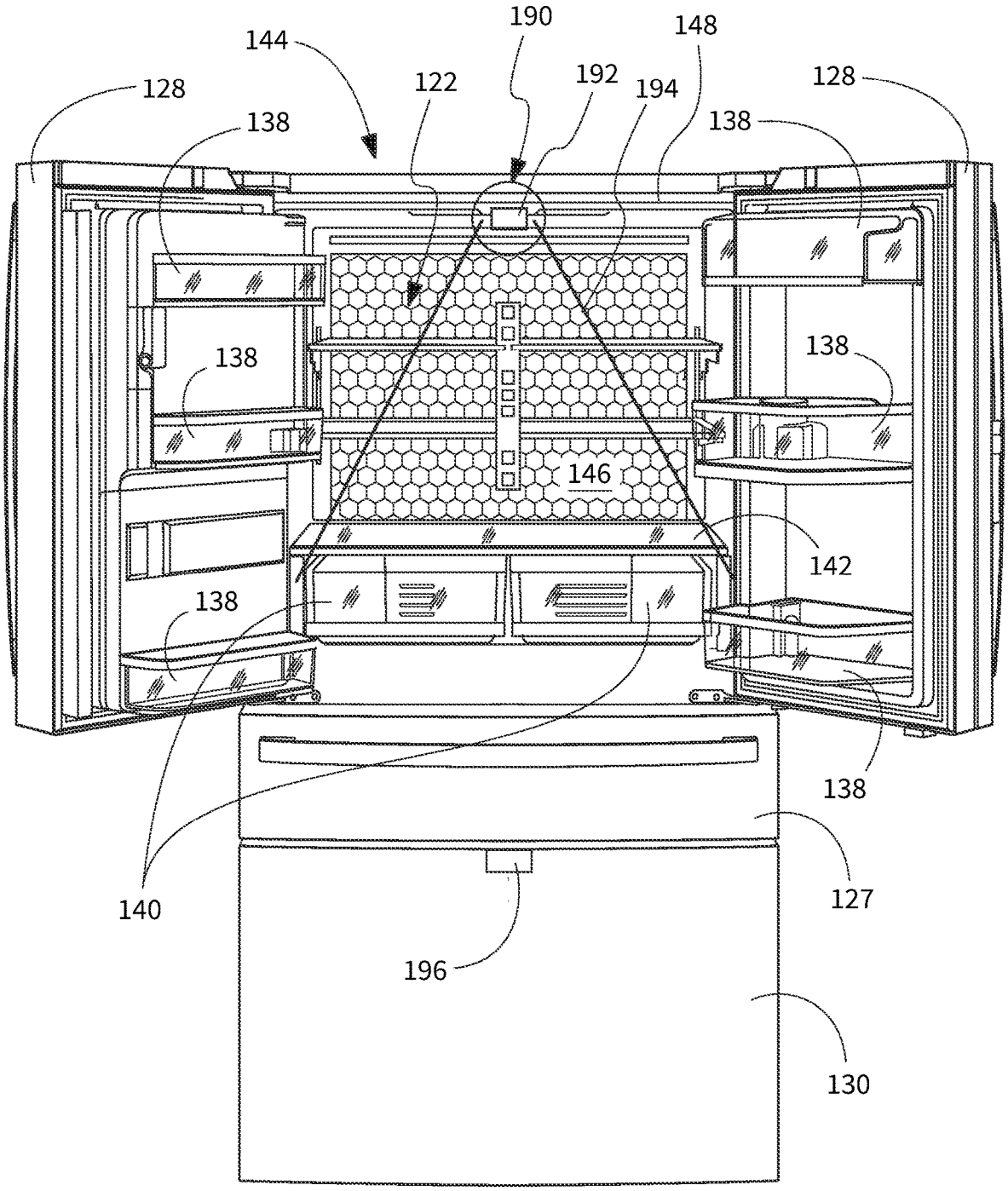
FIG. 3 provides a front view of the refrigerator appliance of FIG. 1 with doors thereof in an open position.

FIG. 1 is a front view of an exemplary embodiment of a refrigerator appliance 100. FIG. 2 is a perspective view of the refrigerator appliance 100. FIG. 3 is a front view of the refrigerator appliance 100 with fresh food doors 128 thereof in an open position. Refrigerator appliance 100 extends between a top 101 and a bottom 102 along a vertical direction V. Refrigerator appliance 100 also extends between a first side 105 and a second side 106 along a lateral direction L. As shown in FIG. 2, a transverse direction T may additionally be defined perpendicular to the vertical and lateral directions V and L. Refrigerator appliance 100 extends along the transverse direction T between a front portion 108 and a back portion 110.

Directional terms such as "left" and "right" are used herein with reference to the perspective of a user standing in front of the refrigerator appliance 100 to access the refrigerator and/or items stored therein. Terms such as "inner" and "outer" refer to relative directions with respect to the interior and exterior of the refrigerator appliance, and in particular the food storage chamber(s) defined therein. For example, "inner" or "inward" refers to the direction towards the interior of the refrigerator appliance. Terms such as "left," "right," "front," "back," "top," or "bottom" are used with reference to the perspective of a user accessing the refrigerator appliance. For example, a user stands in front of the refrigerator to open the doors and reaches into the food storage chamber(s) to access items therein.

Refrigerator appliance 100 includes a cabinet or housing 120 defining an upper fresh food chamber 122 (FIG. 3) and a lower freezer chamber or frozen food storage chamber 124 arranged below the fresh food chamber 122 along the vertical direction V. As may be seen in FIGS. 3 and 4, a plurality of food storage elements, such as bins 138, shelves 142, and drawers 140 are disposed within the fresh food chamber 122. In some embodiments, an auxiliary food storage chamber (not shown) may be positioned between the fresh food chamber 122 and the freezer chamber 124, e.g., along the vertical direction V. Because the freezer chamber 124 is positioned below the fresh food chamber 122, refrigerator appliance 100 is generally referred to as a bottom mount refrigerator. In the exemplary embodiment, housing 120 also defines a mechanical compartment (not shown) for receipt of a sealed cooling system (not shown). Using the teachings disclosed herein, one of skill in the art will understand that the present invention can be used with other types of refrigerators (e.g., side-by-sides, such as the exemplary side-by-side configuration illustrated in FIG. 4) as well. Consequently, the description set forth herein is for illustrative purposes only and is not intended to limit the invention in any aspect.

Figure 4:
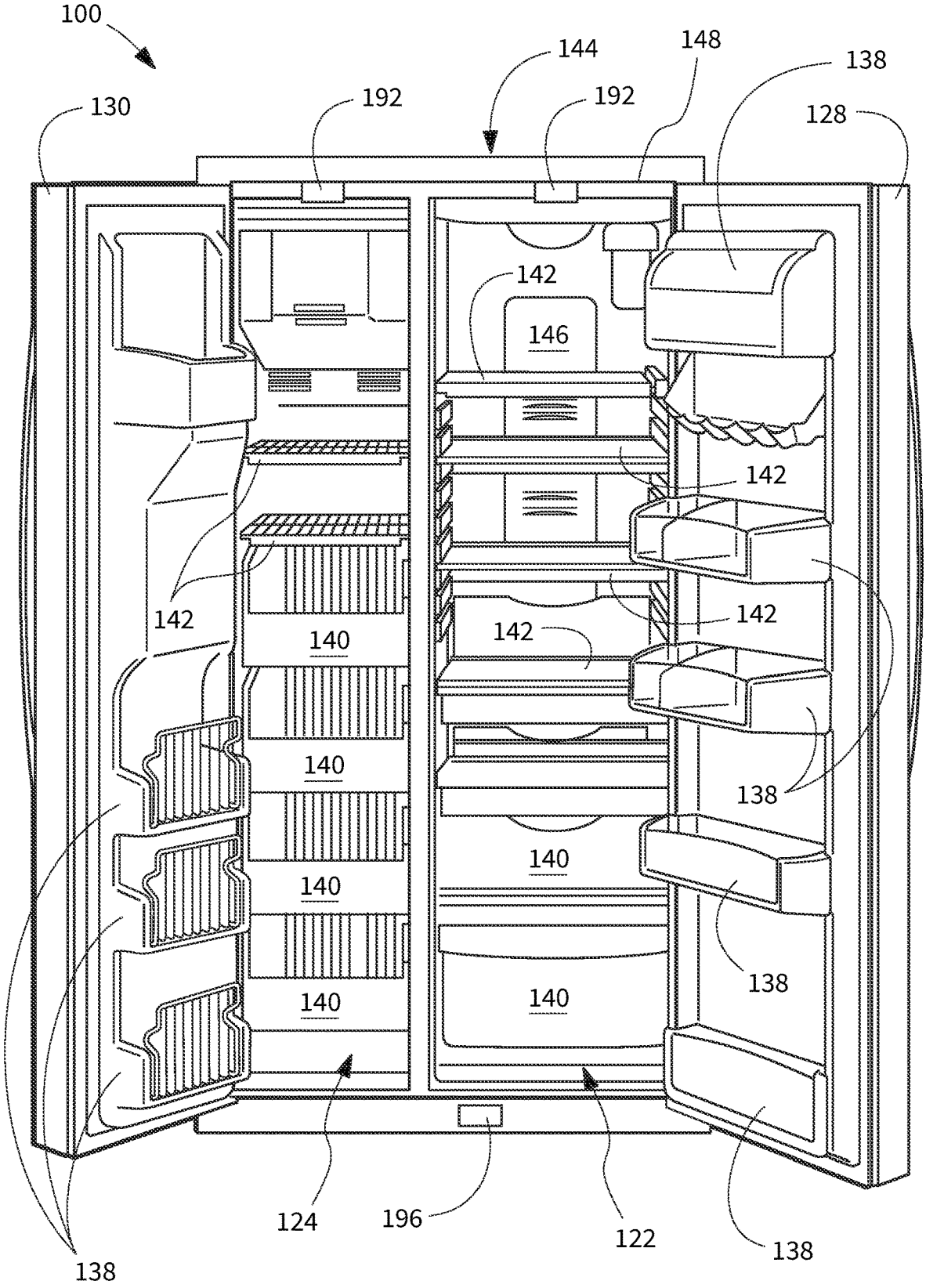
FIG. 4 provides a front view of another exemplary refrigerator appliance with doors thereof in an open position according to one or more additional exemplary embodiments of the present subject matter.

Refrigerator doors 128 are each rotatably hinged to an edge of housing 120 for accessing fresh food chamber 122. As may be seen in FIGS. 3 and 4, the fresh food chamber 122 extends along the transverse direction T between a front portion 144 and a back portion 146. The front portion 144 of the fresh food chamber 122 defines an opening 148 for receipt of food items. Refrigerator doors 128 are rotatably mounted, e.g., hinged, to an edge of housing 120 for selectively accessing fresh food chamber 122. Refrigerator doors 128 may be mounted to the housing 120 at or near the front portion 144 of the fresh food chamber 122 such that the doors 128 rotate between a closed position (FIGS. 1 and 2) where the doors 128 cooperatively sealingly enclose the fresh food chamber 122 and an open position (FIGS. 3 and 4) to permit access to the fresh food chamber 122. It should be noted that while two doors 128 in a "French door" configuration are illustrated in FIG. 3, any suitable arrangement of doors utilizing one, two or more doors is within the scope and spirit of the present disclosure, such as a single door 128 at the fresh food chamber 122 as illustrated in FIG. 4. A freezer door 130 for accessing freezer chamber 124 is arranged below refrigerator doors 128 in some embodiments, e.g., as illustrated in FIG. 3, or beside refrigerator door 128 in some embodiments, e.g., as illustrated in FIG. 4, or may also be located in other arrangements, e.g., above refrigerator door(s) 128. In the exemplary embodiment illustrated in FIG. 3, freezer door 130 is coupled to a freezer drawer (not shown) slidably mounted within freezer chamber 124, while the exemplary freezer door 130 in the embodiment illustrated in FIG. 4 is rotatable coupled to the cabinet 120. An auxiliary door 127 may be coupled to an auxiliary drawer (not shown) which is slidably mounted within the auxiliary chamber (not shown).

Operation of the refrigerator appliance 100 can be regulated by a controller 134 that is operatively coupled to a user interface panel 136. User interface panel 136 provides selections for user manipulation of the operation of refrigerator appliance 100 to modify environmental conditions therein, such as temperature selections, etc. In some embodiments, user interface panel 136 may be proximate a dispenser assembly 132. Panel 136 provides selections for user manipulation of the operation of refrigerator appliance 100 such as, e.g., temperature selections, selection of automatic or manual override humidity control (as described in more detail below), etc. In response to user manipulation of the user interface panel 136, the controller 134 operates various components of the refrigerator appliance 100. Operation of the refrigerator appliance 100 can be regulated by the controller 134, e.g., controller 134 may regulate operation of various components of the refrigerator appliance 100 in response to programming and/or user manipulation of the user interface panel 136.

The controller 134 may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In one embodiment, the processor executes programming instructions stored in memory. The memory may be a separate component from the processor or may be included onboard within the processor. It should be noted that controllers 134 as disclosed herein are capable of and may be operable to perform any methods and associated method steps as disclosed herein.

The controller 134 may be positioned in a variety of locations throughout refrigerator appliance 100. In the illustrated embodiment, the controller 134 may be located within the door 128. In such an embodiment, input/output ("I/O") signals may be routed between the controller and various operational components of refrigerator appliance 100. In one embodiment, the user interface panel 136 may represent a general purpose I/O ("GPIO") device or functional block. In one embodiment, the user interface panel 136 may include input components, such as one or more of a variety of electrical, mechanical or electro-mechanical input devices including rotary dials, push buttons, and touch pads. The user interface panel 136 may include a display component, such as a digital or analog display device designed to provide operational feedback to a user. For example, the user interface panel 136 may include a touchscreen providing both input and display functionality. The user interface panel 136 may be in communication with the controller via one or more signal lines or shared communication busses.

As will be described in more detail below, refrigerator appliance 100 may further include features that are generally configured to detect the presence and, in some embodiments, identity of a user. More specifically, such features may include one or more sensors, e.g., cameras 192 and/or 196 (see, e.g., FIGS. 3 and 4), or other detection devices that are used to monitor the refrigerator appliance 100 and an area in front of the cabinet 120 that is contiguous with a food storage chamber, e.g., the food chamber 122 and/or freezer chamber 124, such as an area in which a user accessing the food storage chamber is likely to be present. The sensors or other detection devices may be operable to detect and monitor presence of one or more users that are accessing the refrigerator appliance 100, and in particular the fresh food chamber 122 and/or freezer chamber 124 thereof. In this regard, the refrigerator appliance 100 may use data from each of these devices to obtain a representation or knowledge of the identity, position, and/or other qualitative or quantitative characteristics of one or more users.

As shown schematically in FIGS. 3 and 4, the user detection system may include a camera assembly 190 that is generally positioned and configured for obtaining images of refrigerator appliance 100 and adjoining areas, e.g., in front of the refrigerator appliance 100, during operation of the camera assembly 190. Specifically, according to the illustrated embodiments in FIGS. 3 and 4, camera assembly 190 includes one or more first cameras 192 and one or more second cameras 196. First camera 192 and second camera 196 may be configured and operable to receive and record varying types of images. For example, the first camera 192 (FIG. 3) or first cameras 192 (FIG. 4) may be a photo camera or cameras, operable to receive and record or capture images based on light having wavelength(s) within the visible light spectrum, while the second camera 196 may be an infrared (IR) camera, e.g., may be operable to receive and record or capture images based on infrared light. The one or more cameras 192, 196 may be mounted to cabinet 120, to doors 128, or otherwise positioned in view of fresh food chamber 122, and/or an area in front of the cabinet 120 that is contiguous with the fresh food chamber 122. As shown in FIG. 3, a camera 192 of camera assembly 190 is mounted to cabinet 120 at the front opening 148 of fresh food chamber 122 and is oriented to have a field of view 194 directed across the front opening and/or into fresh food chamber 122 and in front of the fresh food chamber 122. As shown in FIG. 4, each camera 192 (of the two cameras 192 in this embodiment) is mounted to cabinet 120 at a respective front opening of fresh food chamber 122 and freezer chamber 124, such that each camera 192 is oriented to have a field of view 194 directed across the front opening and/or into each respective food storage chamber and in front of the fresh food chamber 122 and freezer chamber 124.

Although a single camera 192 is illustrated in FIG. 3, it should be appreciated that camera assembly 190 may include a plurality of cameras 192 positioned within cabinet 120, wherein each of the plurality of cameras 192 has a specified monitoring zone or range positioned around refrigerator appliance 100, such as multiple cameras in one or both of the fresh food chamber 122 and the freezer chamber 124. In this regard, for example, the field of view 194 of each camera 192 may be limited to or focused on a specific area, such as in the exemplary embodiment illustrated in FIG. 4, where the exemplary side-by-side configuration includes one camera 192 for each of the fresh food chamber 122 and the freezer chamber 124.

In some embodiments, it may be desirable to activate the photo camera or cameras 192 for limited time durations and only in response to certain triggers. For example, the IR camera, e.g., second camera 196, may be always on and may serve as a proximity sensor, such that the photo camera(s) 192 are only activated after the IR camera 196 detects motion at the front of the refrigerator appliance 100. In additional embodiments, the activation of the first camera(s) 192 may be in response to a door opening, such as detecting that the door was opened using a door switch. In this manner, privacy concerns related to obtaining images of the user of the refrigerator appliance 100 may be mitigated. According to exemplary embodiments, camera assembly 190 may be used to facilitate a user detection and/or identification process for refrigerator appliance 100. As such, each camera 192 may be positioned at the front opening 148 to fresh food chamber 122 to monitor one or more doors 128 and/or 130 and adjoining areas, such as while food items are being added to or removed from fresh food chamber 122 and/or freezer chamber 124.

It should be appreciated that according to alternative embodiments, camera assembly 190 may include any suitable number, type, size, and configuration of camera(s) 192 for obtaining images of any suitable areas or regions within or around refrigerator appliance 100. In addition, it should be appreciated that each camera 192 may include features for adjusting the field of view and/or orientation.

It should be appreciated that the images obtained by camera assembly 190 may vary in number, frequency, angle, resolution, detail, etc. in order to improve the clarity of the particular regions surrounding or within refrigerator appliance 100. In addition, according to exemplary embodiments, controller 134 may be configured for illuminating the chilled chamber (e.g., one or both of fresh food chamber 122 and freezer chamber 124) using one or more light sources prior to obtaining images. Notably, controller 134 of refrigerator appliance 100 (or any other suitable dedicated controller) may be communicatively coupled to camera assembly 190 and may be programmed or configured for analyzing the images obtained by camera assembly 190, e.g., in order to detect and/or identify a user proximate to the refrigerator appliance 100, as described in more detail below.

In general, controller 134 may be operably coupled to camera assembly 190 for analyzing one or more images obtained by camera assembly 190 to extract useful information regarding objects or people within the field of view of the one or more cameras 192 and/or 196. In this regard, for example, images obtained by camera assembly 190 may be used to extract a facial image or other identifying information related to one or more users. Notably, this analysis may be performed locally (e.g., on controller 134) or may be transmitted to a remote server (e.g., in the "cloud," as those of ordinary skill in the art will recognize as referring to a remote server or database in a distributed computing environment including at least one remote computing device) for analysis. Such analysis is intended to facilitate user detection, e.g., by identifying a user accessing the refrigerator appliance, such as adding or removing food items to or from the fresh food chamber 122 and/or freezer chamber 124.

Specifically, according to an exemplary embodiment as illustrated in FIG. 3, camera 192 (or multiple cameras 192 in the camera assembly 190 collectively) may be oriented down from a top center of cabinet 120 and define a field of view 194 (e.g., as shown schematically in FIG. 3) that covers a width of fresh food chamber 122. In this manner, the field of view 194 of camera 192, and the resulting images obtained, may capture any motion or movement of a user placing an object (e.g., food item) into and/or out of the fresh food chamber 122 and/or freezer chamber 124. The images obtained by camera assembly 190 may include one or more still images, one or more video clips, or any other suitable type and number of images suitable for detection and/or identification of a user.

Notably, camera assembly 190 may obtain images upon any suitable trigger, such as a time-based imaging schedule where camera assembly 190 periodically images and monitors the field of view, e.g., in and/or in front of the refrigerator appliance 100. According to still other embodiments, camera assembly 190 may periodically take low-resolution images until motion (such as opening of one or more doors 128 or 130) is detected (e.g., via image differentiation of low-resolution images), at which time one or more high-resolution images may be obtained. According to still other embodiments, refrigerator appliance 100 may include one or more motion sensors (e.g., optical, acoustic, electromagnetic, etc.) that are triggered when an object or user moves into or through the area in front of the refrigerator appliance 100, and camera assembly 190 may be operably coupled to such motion sensors to obtain images of the object 182 during such movement.

According to still other embodiments, refrigerator appliance 100 may include a door switch that detects when refrigerator door 128 is opened, at which point camera assembly 190 may begin obtaining one or more images. According to exemplary embodiments, the image may be obtained continuously or periodically while doors 128 and/or 130 are open. In this regard, obtaining one or more images may include determining that a door of the refrigerator appliance is open and capturing images at a set frame rate while the door is open.

It should be appreciated that the images obtained by camera assembly 190 may vary in number, frequency, angle, resolution, detail, etc. in order to improve the clarity thereof. In addition, according to exemplary embodiments, controller 134 may be configured for illuminating a refrigerator light (not shown) while obtaining the image or images. Other suitable imaging triggers are possible and within the scope of the present subject matter.

Using the teachings disclosed herein, one of skill in the art will understand that the present subject matter can be used with other types of refrigerators such as a refrigerator/freezer combination, side-by-side, bottom mount, compact, and any other style or model of refrigerator appliance. Accordingly, other configurations of refrigerator appliance 100 could be provided, it being understood that the configurations shown in the accompanying FIGS. and the description set forth herein are by way of example for illustrative purposes only.

Figure 5:
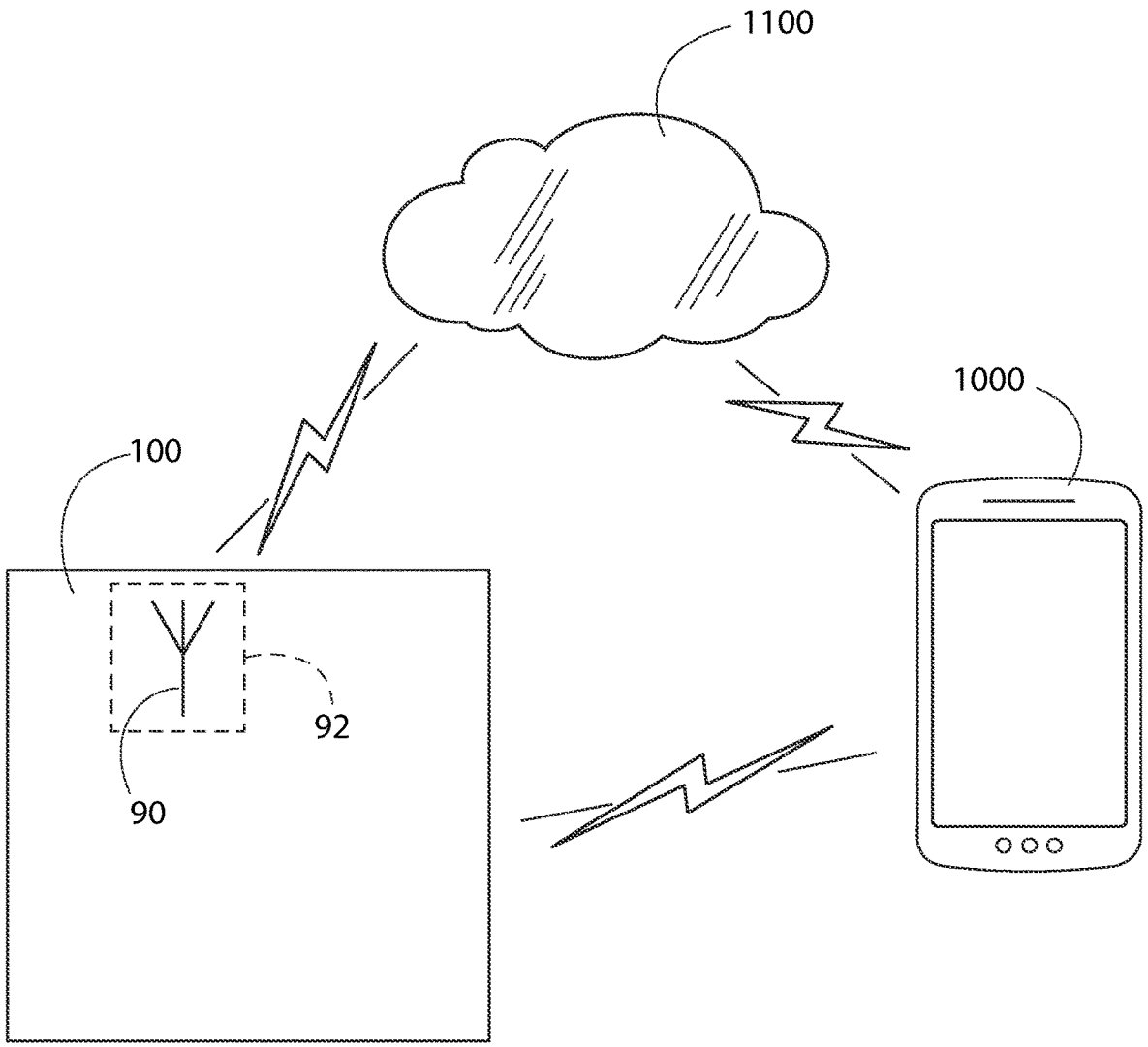
FIG. 5 provides a diagrammatic illustration of an exemplary refrigerator appliance in communication with one or more additional devices.

Turning now to FIG. 5, a general schematic of a refrigerator appliance, generally designated by reference number 10 (without intending to limit the appliance of FIG. 5 to any particular refrigerator appliance, e.g., the appliance 10 of FIG. 5 may be either of the bottom mount refrigerator (FIGS. 1-3) or the side-by-side refrigerator (FIG. 4) described above which are example embodiments of a refrigerator appliance, but the refrigerator appliance 10 of FIG. 5 is not limited to those particular examples) and communication features thereof. FIG. 5 schematically illustrates a refrigerator appliance 10, which communicates wirelessly with a remote user interface device 1000. For example, as illustrated in FIG. 5, the refrigerator appliance 10 may include an antenna 90 by which the refrigerator appliance 10 communicates with, e.g., sends and receives signals to and from, the remote user interface device 1000. The antenna 90 may be part of, e.g., onboard, a communications module 92. The communications module 92 may be a wireless communications module operable to connect wirelessly, e.g., over the air, to one or more other devices via any suitable wireless communication protocol. For example, the communications module 92 may be a WI-FI® module, a BLUETOOTH® module, or a combination module providing both WI-FI® and BLUETOOTH® connectivity. The remote user interface device 1000 may be a laptop computer, smartphone, tablet, personal computer, wearable device, smart home system, and/or various other suitable devices.

The refrigerator appliance 10 may be in communication with the remote user interface device 1000 device through various possible communication connections and interfaces. The refrigerator appliance 10 and the remote user interface device 1000 may be matched in wireless communication, e.g., connected to the same wireless network. The refrigerator appliance 10 may communicate with the remote user interface device 1000 via short-range radio such as BLUETOOTH® or any other suitable wireless network having a layer protocol architecture. As used herein, "short-range" may include ranges less than about ten meters and up to about one hundred meters. For example, the wireless network may be adapted for short-wavelength ultra-high frequency (UHF) communications in a band between 2.4 GHz and 2.485 GHz (e.g., according to the IEEE 802.15.1 standard). In particular, BLUETOOTH® Low Energy, e.g., BLUETOOTH® Version 4.0 or higher, may advantageously provide short-range wireless communication between the refrigerator appliance 10 and the remote user interface device 1000. For example, BLUETOOTH® Low Energy may advantageously minimize the power consumed by the exemplary methods and devices described herein due to the low power networking protocol of BLUETOOTH® Low Energy.

The remote user interface device 1000 is "remote" at least in that it is spaced apart from and not physically connected to the refrigerator appliance 10, e.g., the remote user interface device 1000 is a separate, stand-alone device from the refrigerator appliance 10 which communicates with the refrigerator appliance 10 wirelessly. Any suitable device separate from the refrigerator appliance 10 that is configured to provide and/or receive communications, information, data, or commands from a user may serve as the remote user interface device 1000, such as a smartphone (e.g., as illustrated in FIG. 5), smart watch, personal computer, smart home system, or other similar device. For example, the remote user interface device 1000 may be a smartphone operable to store and run applications, also known as "apps," and some or all of the method steps disclosed herein may be performed by a smartphone app.

The remote user interface device 1000 may include a memory for storing and retrieving programming instructions. Thus, the remote user interface device 1000 may provide a remote user interface which may be an additional user interface to the user interface panel 136. For example, the remote user interface device 1000 may be a smartphone operable to store and run applications, also known as "apps," and the remote user interface may be provided as a smartphone app.

As mentioned above, the refrigerator appliance 10 may also be configured to communicate wirelessly with a network 1100. The network 1100 may be, e.g., a cloud-based data storage system including one or more remote databases and/or remote servers, which may be collectively referred to as "the cloud." For example, the refrigerator appliance 10 may communicate with the cloud 1100 over the Internet, which the refrigerator appliance 10 may access via WI-FI®, such as from a WI-FI® access point in a user's home.

Now that the construction and configuration of refrigerator appliance 100 have been presented according to an exemplary embodiment of the present subject matter, exemplary methods for operating a refrigerator appliance, such as refrigerator appliance 100, are provided. In this regard, for example, controller 134 may be configured for implementing one or more of the following exemplary methods. However, it should be appreciated that the exemplary methods are discussed herein only to describe exemplary aspects of the present subject matter, and are not intended to be limiting.

Figure 6:
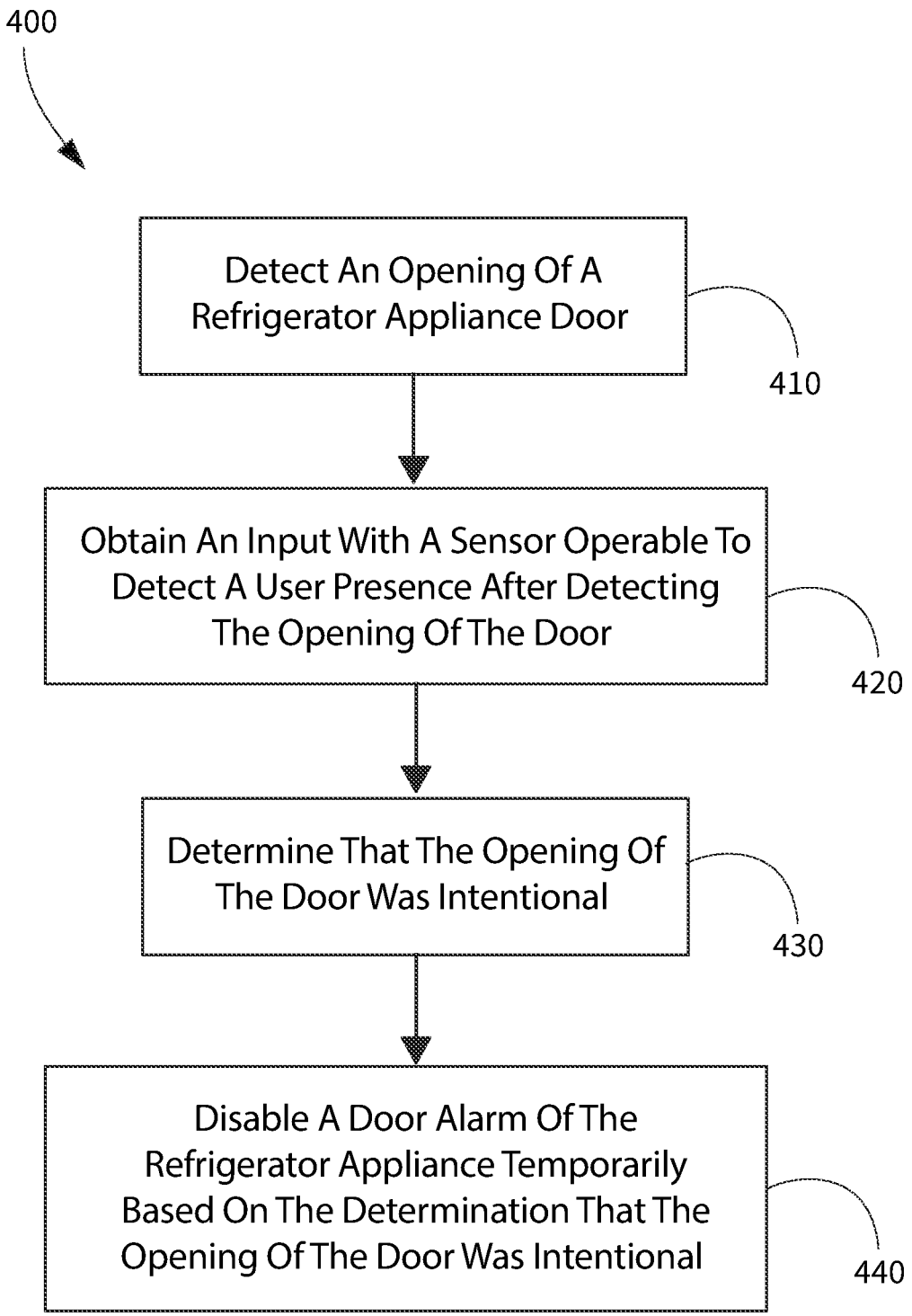
FIG. 6 provides a flow diagram of an exemplary method for operating a refrigerator appliance according to one or more exemplary embodiments of the present subject matter.

Turning now to FIG. 6, embodiments of the present disclosure may include a method 400 of operating a refrigerator appliance, such as the exemplary refrigerator appliance 100 described above. For example, the refrigerator appliance may include a controller and a cabinet defining a food storage chamber (e.g., one of the fresh food chamber 122 or the freezer chamber 124) with a door movably, e.g., rotatably or slidably, coupled to the cabinet such that the door is movable, e.g., rotatable or slidable, between a closed position and an open position. In the closed position, the food storage chamber is at least partially enclosed by the door, such as cooperatively sealingly enclosed by the door and a second door when both doors are in the closed position, such as in the French door configuration of fresh food doors 128, e.g., illustrated in FIG. 3 and described above, or sealingly enclosed by the single door alone, e.g., as in freezer doors 130 of FIGS. 3 and 4, or the single fresh food door 128 of FIG. 4. In the open position, the door permits access to the food storage chamber.

Also by way of example, the refrigerator may further include a sensor operable to detect a user presence. In some embodiments, the sensor may be or include a camera assembly positioned and configured for monitoring the food storage chamber and an area in front of the cabinet that is contiguous with the food storage chamber, such as the camera assemblies described above with respect to FIGS. 3 and 4. In additional embodiments, the sensor may also or instead include sensors configured to detect and/or respond to vibration, sound, or any other input to detect a person in front of the refrigerator appliance.

As shown in FIG. 6, method 400 includes, at step 410, detecting an opening of the door. The opening of the door may be detected using, for example, a door switch, as is generally recognized in the art, and/or low-resolution images, as described above. After detecting the opening of the door, the method 400 includes obtaining an input with the sensor after detecting the opening of the door, e.g., as indicated at step 420 in FIG. 6. In embodiments where the sensor includes one or more cameras, step 420 may include obtaining an image of a chilled chamber of the refrigerator appliance and/or an adjoining area in front of the refrigerator appliance using the camera assembly. For example, camera assembly 190 of refrigerator appliance 100 may obtain an image within and/or in front of the refrigerator appliance 100. In this regard, camera assembly 190 of refrigerator appliance 100 may obtain one or more images of fresh food chamber 122, freezer chamber 124, or any other zone or region within or around refrigerator appliance 100.

In some embodiments, the method may also include, and/or the refrigerator appliance may further be configured for, detecting or identifying one or more users, e.g., based on one or more images. In some embodiments, detection of the user(s) may be accomplished with the camera assembly 190. For example, the refrigerator appliance may include a camera, and the step of obtaining an input with the sensor may include capturing an image with the camera. Such embodiments may further include detecting the user(s) based on the image captured by the camera. In some embodiments, the operation of the camera may be tied to the door opening, e.g., the camera may be operable and configured to capture an image each time the door is opened and/or each time the door is closed after detecting a door opening. The structure and operation of cameras are understood by those of ordinary skill in the art and, as such, the camera is not illustrated or described in further detail herein for the sake of brevity and clarity. In such embodiments, the controller 134 of the refrigerator appliance 100 may be configured for image-based processing, e.g., to detect a user based on an image of the user, e.g., a photograph taken with the camera(s) 192 of the camera assembly 190. For example, the controller 134 may be configured to identify the user by comparison of the image to a stored image of a known or previously-identified user. For example, controller 134 of refrigerator appliance 100 (or any other suitable dedicated controller) may be communicatively coupled to camera assembly 190 and may be programmed or configured for analyzing the images obtained by camera assembly 190, e.g., in order to detect a user accessing refrigerator appliance 100, such as food items therein.

In some exemplary embodiments, the method 400 may include analyzing one or more images, e.g., such image(s) may be an embodiment of the input that was obtained at step 420, to detect a user. It should be appreciated that this analysis may utilize any suitable image analysis techniques, image decomposition, image segmentation, image processing, etc. This analysis may be performed entirely by controller 134, may be offloaded to a remote server (e.g., in the cloud 1100) for analysis, may be analyzed with user assistance (e.g., via user interface panel 136), or may be analyzed in any other suitable manner. According to exemplary embodiments of the present subject matter, the analysis may include a machine learning image recognition process.

According to exemplary embodiments, this image analysis may use any suitable image processing technique, image recognition process, etc. As used herein, the terms "image analysis" and the like may be used generally to refer to any suitable method of observation, analysis, image decomposition, feature extraction, image classification, etc. of one or more images, videos, or other visual representations of an object. As explained in more detail below, this image analysis may include the implementation of image processing techniques, image recognition techniques, or any suitable combination thereof. In this regard, the image analysis may use any suitable image analysis software or algorithm to constantly or periodically monitor refrigerator appliance 100 and/or a proximate and contiguous area in front of the fresh food chamber 122 and/or freezer chamber 124. It should be appreciated that this image analysis or processing may be performed locally (e.g., by controller 134) or remotely (e.g., by offloading image data to a remote server or network, e.g., in the cloud).

Specifically, the analysis of the one or more images may include implementation an image processing algorithm. As used herein, the terms "image processing" and the like are generally intended to refer to any suitable methods or algorithms for analyzing images that do not rely on artificial intelligence or machine learning techniques (e.g., in contrast to the machine learning image recognition processes described below). For example, the image processing algorithm may rely on image differentiation, e.g., such as a pixel-by-pixel comparison of two sequential images. This comparison may help identify substantial differences between the sequentially obtained images, e.g., to identify movement, the presence of a particular object, the existence of a certain condition, etc. For example, one or more reference images may be obtained when a particular condition exists, and these references images may be stored for future comparison with images obtained during appliance operation. Similarities and/or differences between the reference image and the obtained image may be used to extract useful information for improving appliance performance. For example, image differentiation may be used to determine when a pixel level motion metric passes a predetermined motion threshold.

The processing algorithm may further include measures for isolating or eliminating noise in the image comparison, e.g., due to image resolution, data transmission errors, inconsistent lighting, or other imaging errors. By eliminating such noise, the image processing algorithms may improve accurate object detection, avoid erroneous object detection, and isolate the important object, region, or pattern within an image. In addition, or alternatively, the image processing algorithms may use other suitable techniques for recognizing or identifying particular items or objects, such as edge matching, divide-and-conquer searching, greyscale matching, histograms of receptive field responses, or another suitable routine (e.g., executed at the controller 134 based on one or more captured images from one or more cameras). Other image processing techniques are possible and within the scope of the present subject matter.

In addition to the image processing techniques described above, the image analysis may include utilizing artificial intelligence ("AI"), such as a machine learning image recognition process, a neural network classification module, any other suitable artificial intelligence (AI) technique, and/or any other suitable image analysis techniques, examples of which will be described in more detail below. Moreover, each of the exemplary image analysis or evaluation processes described below may be used independently, collectively, or interchangeably to extract detailed information regarding the images being analyzed to facilitate performance of one or more methods described herein or to otherwise improve appliance operation. According to exemplary embodiments, any suitable number and combination of image processing, image recognition, or other image analysis techniques may be used to obtain an accurate analysis of the obtained images.

In this regard, the image recognition process may use any suitable artificial intelligence technique, for example, any suitable machine learning technique, or for example, any suitable deep learning technique. According to an exemplary embodiment, the image recognition process may include the implementation of a form of image recognition called region based convolutional neural network ("R-CNN") image recognition. Generally speaking, R-CNN may include taking an input image and extracting region proposals that include a potential object or region of an image. In this regard, a "region proposal" may be one or more regions in an image that could belong to a particular object or may include adjacent regions that share common pixel characteristics. A convolutional neural network is then used to compute features from the region proposals and the extracted features will then be used to determine a classification for each particular region.

According to still other embodiments, an image segmentation process may be used along with the R-CNN image recognition. In general, image segmentation creates a pixel-based mask for each object in an image and provides a more detailed or granular understanding of the various objects within a given image. In this regard, instead of processing an entire image—i.e., a large collection of pixels, many of which might not contain useful information—image segmentation may involve dividing an image into segments (e.g., into groups of pixels containing similar attributes) that may be analyzed independently or in parallel to obtain a more detailed representation of the object or objects in an image. This may be referred to herein as "mask R-CNN" and the like, as opposed to a regular R-CNN architecture. For example, mask R-CNN may be based on fast R-CNN which is slightly different than R-CNN. For example, R-CNN first applies a convolutional neural network ("CNN") and then allocates it to zone recommendations on the covn5 property map instead of the initially split into zone recommendations. In addition, according to exemplary embodiments, standard CNN may be used to obtain, identify, or detect any other qualitative or quantitative data related to one or more objects or regions within the one or more images. In addition, a K-means algorithm may be used.

According to still other embodiments, the image recognition process may use any other suitable neural network process while remaining within the scope of the present subject matter. For example, the step of analyzing the one or more images may include using a deep belief network ("DBN") image recognition process. A DBN image recognition process may generally include stacking many individual unsupervised networks that use each network's hidden layer as the input for the next layer. According to still other embodiments, the step of analyzing one or more images may include the implementation of a deep neural network ("DNN") image recognition process, which generally includes the use of a neural network (computing systems inspired by the biological neural networks) with multiple layers between input and output. Other suitable image recognition processes, neural network processes, artificial intelligence analysis techniques, and combinations of the above described or other known methods may be used while remaining within the scope of the present subject matter.

In addition, it should be appreciated that various transfer techniques may be used but use of such techniques is not required. If using transfer techniques learning, a neural network architecture may be pretrained such as VGG16/VGG19/ResNet50 with a public dataset then the last layer may be retrained with an appliance specific dataset. In addition, or alternatively, the image recognition process may include detection of certain conditions based on comparison of initial conditions, may rely on image subtraction techniques, image stacking techniques, image concatenation, etc. For example, the subtracted image may be used to train a neural network with multiple classes for future comparison and image classification.

It should be appreciated that the machine learning image recognition models may be actively trained by the appliance with new images, may be supplied with training data from the manufacturer or from another remote source, or may be trained in any other suitable manner. For example, according to exemplary embodiments, this image recognition process relies at least in part on a neural network trained with a plurality of images of the appliance in different configurations, experiencing different conditions, or being interacted with in different manners. This training data may be stored locally or remotely and may be communicated to a remote server for training other appliances and models.

It should be appreciated that image processing and machine learning image recognition processes may be used together to facilitate improved image analysis, object detection, or to extract other useful qualitative or quantitative data or information from the one or more images that may be used to improve the operation or performance of the appliance. Indeed, the methods described herein may use any or all of these techniques interchangeably to improve image analysis process and facilitate improved appliance performance and consumer satisfaction. The image processing algorithms and machine learning image recognition processes described herein are only exemplary and are not intended to limit the scope of the present subject matter in any manner.

Method 400 may also include a step 430 of determining that the opening of the door was intentional. For example, the input, e.g., image, may be analyzed to determine that a user is present in front of the refrigerator appliance 100. Thus, it may be determined that the opening of the door was intentional based on the input obtained at step 420 because the user is present at the refrigerator appliance, e.g., loading or unloading the refrigerator appliance. As another example, a user input may be received which indicates that the door opening was intentional, and it may thereby be determined that the door opening was intentional based on the user input.

As illustrated in FIG. 6, method 400 may then include disabling a door alarm of the refrigerator appliance. The door alarm may be temporarily disabled. In at least some embodiments, the door alarm may be automatically reenabled. The door alarm may be disabled based on the determination that the opening of the door was intentional.

In some embodiments, the analysis of the input and the determination that the door opening was intentional may be performed using an intentional door opening detection software. The intentional door opening software may be built by a remote server, e.g., in the cloud, and may further be updated and/or re-built with additional inputs at subsequent door openings. For example, the intentional door opening software may be trained using one or more user inputs. Thus, in some embodiments, e.g., at initial or prior intentional door opening events, the determination that the opening of the door was intentional may include receiving a user input that indicates the opening of the door was intentional. Such user input may include an intentional door opening mode selection, e.g., prior to the door opening, or a manual deactivation of the door alarm, e.g., after detecting the door opening and activating the door alarm.

When the refrigerator appliance receives such user input(s) and thus determines that the door opening was intentional, the refrigerator appliance may then gather data, e.g., obtain input with the sensor, such as images obtained with one or more cameras, and the gathered data may be used to rebuild or update the intentional door opening software. For example, the intentional door opening software may be built by a remote server, e.g., in the cloud, and downloaded by the refrigerator appliance, such as transmitted from the remote server and received by the refrigerator appliance. Then, at a subsequent intentional door opening (which may be determined automatically, e.g., by analyzing sensor input such as camera images, and/or based on manual user input) additional data may be gathered and such additional data may be sent to the cloud, such as transmitted from the refrigerator appliance and received by the remote server. The remote server may then use the additional data to update and/or rebuild the intentional door opening software. The updated intentional door opening software may then be transmitted to, e.g., re-downloaded by, the refrigerator appliance. Accordingly, the intentional door opening software may be continuously updated and the accuracy of the intentional door opening software may be continuously improved with additional data. In particular, the remote server may be in communication with numerous refrigerator appliances, may receive data from multiple of the refrigerator appliances, and may update the intentional door opening software based on all the data from the multiple refrigerator appliances.

Thus, in some embodiments, method 400 may also include transmitting the input obtained from the sensor at step 420 to a remote server from the refrigerator appliance after receiving the user input. In such embodiments, method 400 may further include building an intentional door opening detection software by the remote server based on the input obtained from the sensor. The intentional door opening detection software may then be transmitted from the remote server to the refrigerator appliance.

In some embodiments, the method 400 may include downloading intentional door opening detection software from a remote server prior to detecting the opening of the door. In such embodiments, the step of 430 determining that the opening of the door was intentional may include analyzing the input obtained from the sensor with the previously downloaded intentional door opening detection software.

Further embodiments may include both initially downloading the intentional door opening detection software from the remote server prior to detecting the opening of the door, followed by uploading the input obtained at step 420, e.g., transmitting the input obtained from the sensor at step 420, to the remote server from the refrigerator appliance after determining that the door opening was intentional (by analyzing the input locally and/or by receiving a user input indicating that the door opening is or was intentional). Thus, the intentional door opening detection software may then be updated or rebuilt by the remote server, and the updated or rebuilt intentional door opening detection software may be downloaded by the refrigerator appliance for use in a subsequent door opening.

Figure 7:
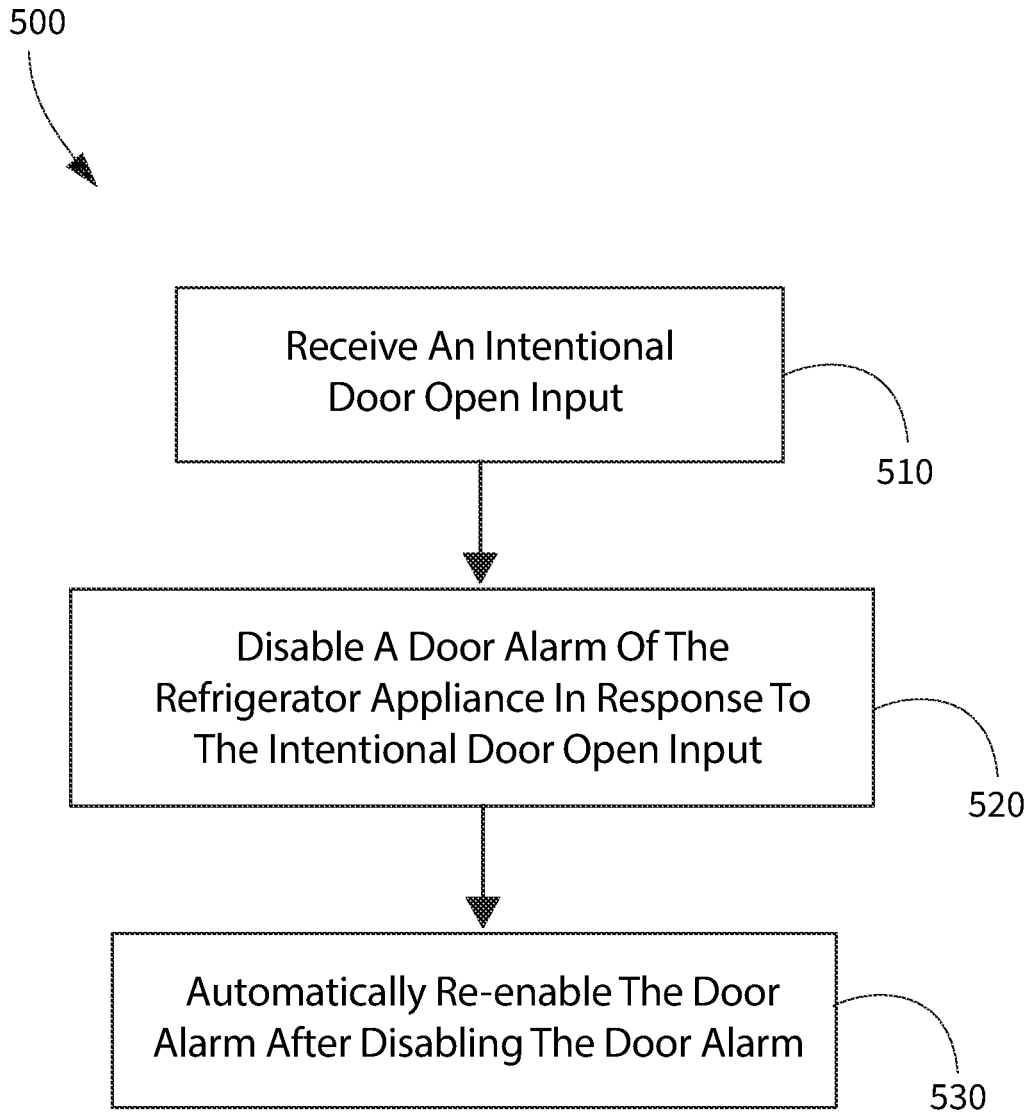
FIG. 7 provides a flow diagram of another exemplary method for operating a refrigerator appliance according to one or more additional exemplary embodiments of the present subject matter.

Turning now to FIG. 7, embodiments of the present disclosure may include a method 500 of operating a refrigerator appliance, such as the exemplary refrigerator appliance 100 described above. Method 500 generally includes an intentional door opening mode where the door alarm is temporarily disabled and then automatically reenabled when the intentional door opening mode is activated, e.g., in response to a user selection of such mode. For example, as illustrated in FIG. 7, the method 500 may include a step 510 of receiving an intentional door open input, e.g., an intentional door open mode selection. In this embodiment, and in various methods and operations described herein throughout which include receiving one or more user inputs, the user input may be received locally, e.g., from the user interface panel 136 (e.g., FIG. 1) on the refrigerator appliance 100, or remotely, e.g., from a remote user interface device 1000 (FIG. 5).

Still referring to FIG. 7, method 500 may also include a step 520 of disabling a door alarm of the refrigerator appliance in response to the intentional door open input. Method 500 may further include a step 530 of automatically reenabling the door alarm after disabling the door alarm. For example, the step 530 of automatically re-enabling the door alarm may include automatically re-enabling the door alarm after a predefined period of time. In some exemplary embodiments, the predefined period of time is defined based on a user input. As another example, the step of 530 automatically re-enabling the door alarm may include automatically re-enabling the door alarm when a door closing is detected, e.g., with a door switch as noted above (e.g., the same switch which may detect the door opening may also detect the door closing).

In at least some embodiments, the intentional door opening mode may also include gathering data (e.g., input from the sensor operable to detect a user presence) that will be transmitted to the remote server, e.g., in the cloud, to build or update intentional door opening software.

In addition to training, e.g., updating, the intentional door opening detection software, other settings or parameters of the refrigerator appliance may also be adjusted or updated. For example, the refrigerator appliance may be pre-programmed, e.g., at manufacture, with a default door alarm time, e.g., where the door alarm activates after the door has been open for the default door alarm time. In some embodiments, when the input obtained with the sensor includes an identification of a particular user, and the particular user has a greater historical incidence of disabling the door alarm and/or has a history (as indicated, e.g., by data gathered by the refrigerator appliance over time during prior door openings with the same user being identified at the prior door openings, where such data may include a user identity and a door open time, as well as a door alarm status, etc.) of intentionally opening the door for an extended period of time (such as a length of time greater than the pre-programmed default door alarm time), the door alarm time parameter may be updated with a longer door alarm delay time before the door alarm is activated in response to detecting and/or identifying the particular user. Additionally, the door alarm may also or instead be disabled temporarily in response to detecting the particular user, e.g., until the door closing is detected.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a refrigerator appliance, the refrigerator appliance comprising a cabinet defining a food storage chamber with a door movably coupled to the cabinet whereby the door is movable between a closed position where the food storage chamber is at least partially enclosed by the door and an open position where the door permits access to the food storage chamber, and a sensor operable to detect a presence and identity of a user, the method comprising:

downloading an initial version of an intentional door opening detection software from a remote server;

detecting an opening of the door after downloading the initial version of the intentional door opening detection software from the remote server;

obtaining an input with the sensor after detecting the opening of the door, the sensor comprising a camera assembly, the input comprising an image of the user;

determining the identity of the user by comparing the image of the user to a stored image of a known user;

determining that the opening of the door was intentional, wherein determining that the opening of the door was intentional comprises receiving a user input that indicates the opening of the door was intentional;

disabling a door alarm of the refrigerator appliance temporarily based on the determination that the opening of the door was intentional;

transmitting the input obtained from the sensor and the identity of the user to the remote server from the refrigerator appliance after determining that the opening of the door was intentional;

building an updated version of the intentional door opening detection software by the remote server based on the input obtained from the sensor and the identity of the user; and transmitting the updated version of the intentional door opening detection software from the remote server to the refrigerator appliance.

2. The method of claim 1, wherein the user input comprises an intentional door open mode selection received prior to detecting the opening of the door.

3. The method of claim 1, further comprising activating the door alarm after detecting the opening of the door, wherein the user input is received after activating the door alarm.

4. The method of claim 1, further comprising detecting a subsequent opening of the door after transmitting the updated version of the intentional door opening detection software from the remote server to the refrigerator appliance, obtaining a second input with the sensor after detecting the subsequent opening of the door, and determining that the subsequent opening of the door was intentional, wherein the step of determining that the subsequent opening of the door was intentional comprises analyzing the second input obtained from the sensor with the updated version of the intentional door opening detection software.

5. The method of claim 1, wherein the camera assembly is positioned and configured for monitoring the food storage chamber and an area in front of the cabinet that is contiguous with the food storage chamber.

6. The method of claim 5, wherein the camera assembly comprises an infrared camera.

7. A refrigerator appliance, comprising:

a cabinet defining a food storage chamber;

a door movably coupled to the cabinet whereby the door is movable between a closed position where the food storage chamber is at least partially enclosed by the door and an open position where the door permits access to the food storage chamber;

a sensor operable to detect a presence and identity of a user; and a controller, the controller operable for:

downloading an initial version of an intentional door opening detection software from a remote server;

detecting an opening of the door after downloading the initial version of the intentional door opening detection software from the remote server;

obtaining an input with the sensor after detecting the opening of the door, the sensor comprising a camera assembly, the input comprising an image of the user;

determining the identity of the user by comparing the image of the user to a stored image of a known user;

determining that the opening of the door was intentional, wherein determining that the opening of the door was intentional comprises receiving a user input that indicates the opening of the door was intentional;

temporarily disabling a door alarm of the refrigerator appliance based on the determination that the opening of the door was intentional;

transmitting the input obtained from the sensor and the identity of the user to the remote server after determining that the opening of the door was intentional; and downloading an updated version of the intentional door opening detection software from the remote server, wherein the updated version of the intentional door opening detection software is built by the remote server based on the input obtained from the sensor and the identity of the user.

8. The refrigerator appliance of claim 7, wherein the user input comprises an intentional door open mode selection received prior to detecting the opening of the door.

9. The refrigerator appliance of claim 7, wherein the controller is further operable for activating the door alarm after detecting the opening of the door, wherein the user input is received after activating the door alarm.

10. The refrigerator appliance of claim 7, wherein the controller is further operable for detecting a subsequent opening of the door after downloading the updated version of the intentional door opening detection software from the remote server, obtaining a second input with the sensor after detecting the subsequent opening of the door, and determining that the subsequent opening of the door was intentional, wherein the controller is operable for determining that the subsequent opening of the door was intentional by analyzing the second input obtained from the sensor with the updated version of the intentional door opening detection software.

11. The refrigerator appliance of claim 7, wherein the camera assembly is positioned and configured for monitoring the food storage chamber and an area in front of the cabinet that is contiguous with the food storage chamber.

12. The refrigerator appliance of claim 11, wherein the camera assembly comprises an infrared camera.

* * * * *